United States Patent [19]

Petrovic

[11] 4,321,524

[45] Mar. 23, 1982

[54] TRANSISTORIZED VOLTAGE LIMITER

[76] Inventor: Marko Petrovic, Jevremova 25, 11000 Belgrade, Yugoslavia

[21] Appl. No.: 83,417

[22] Filed: Oct. 10, 1979

[30] Foreign Application Priority Data

Oct. 16, 1978 [YU] Yugoslavia ..... 2430/78

[51] Int. Cl.[3] ..... G05F 3/08

[52] U.S. Cl. ..... 323/229; 307/318; 323/304; 323/231; 361/91

[58] Field of Search ..... 307/302, 318; 361/56, 361/91; 323/8, 22 Z, 304, 311, 229, 231; 357/13

[56] References Cited

U.S. PATENT DOCUMENTS 2,655,609 10/1953 Shockley ..... 307/318

FOREIGN PATENT DOCUMENTS 1919203 11/1969 Fed. Rep. of Germany ..... 307/318

2038983 2/1972 Fed. Rep. of Germany ..... 323/8

OTHER PUBLICATIONS

G.E. Transistor Manual, Seventh Edition, pp. 395 & 396, 1964.

*Primary Examiner*—William H. Beha, Jr.

*Attorney, Agent, or Firm*—Brumbaugh, Graves, Donohue & Raymond

[57] ABSTRACT

The invention relates to a transistorized voltage limiter as a dipole having in the conduction direction the characteristic similar to that of the Zener diode. When low voltage is involved, this transistorized voltage limiter can replace the Zener diode in various electronic circuits for the stabilization of voltage. Moreover, it has a small dynamic resistance and eliminates noises in the curve.

2 Claims, 3 Drawing Figures

TRANSISTORIZED VOLTAGE LIMITER

The invention relates to a transistorized voltage limiter constructed as a dipole and having in the conduction direction a voltage current characteristic similar to that of the Zener diode but with a stable voltage of about 1 V.

BACKGROUND OF THE INVENTION

It is known that Zener diodes of low nominal Zener voltages have a rounded elbow and a comparatively high dynamic resistance ($\Delta U/\Delta I$) in the working range of the characteristic.

This shortcoming, i.e., high dynamic resistance increases appreciably with the lower Zener voltages such that at low voltages such as 1 volt, Zener diodes can hardly or not at all be utilized in their basic function as voltage limiters.

SUMMARY OF THE INVENTION

The main advantage of the transistorized voltage limiter according to this invention is that it can, in various electronic circuits for the stabilization of voltage, current, etc., perform its function at a low voltage, e.g., 1 V, at which the Zener diode cannot operate effectively.

Another advantage of the invention is an exceptionally low dynamic resistance ($\Delta U/\Delta I$), of the order of 1 ($\Omega$). In a certain interval, with stronger currents, the dynamic resistance is negative, and is also low in absolute value. Consequently, there appears in the characteristic U-I curve a comparatively large range in which the dynamic resistance can be considered as being zero. The elbow of the characteristic is sharp (right angle), but nevertheless with a small roundness. No noise appears in the curve, which also is an advantage.

The foregoing advantages are achieved in accordance with the present invention by connecting a diode across the base-collector junctions of a pair of complementary type transistors, cross coupled from collector to base. The diode is forward biased when the transistors are rendered conductive upon application of a predetermined voltage between their emitters.

BRIEF DESCRIPTION OF THE DRAWINGS

The features of the invention will become more apparent from the following detailed description thereof, taken in conjunction with the appended drawings, in which.

DETAILED DESCRIPTION OF THE INVENTION

Figure 1:
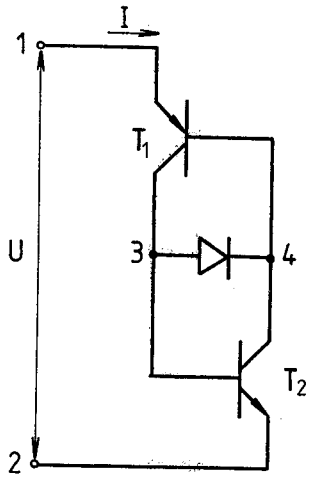
FIG. 1 is a circuit diagram of the invention.

The invention is shown on the diagram of FIG. 1. The circuit is a dipole with terminals at 1 and 2. The voltage between terminals 1 and 2 and the current through the circuit are indicated by U and I respectively.

The circuit comprises the transistors $T_1$ and $T_2$, and the diode. The transistor $T_1$ is PNP, while $T_2$ is NPN. The types of the semiconducting elements should be suitably selected. Good results are achieved with silicon transistors and a germanium diode of low resistance in the conduction direction.

The emitter of transistor $T_1$ is one end of the dipole. Its collector is connected at 3 with the base of transistor $T_2$. Its base is connected at 4 with the collector of transistor $T_2$. The emitter of transistor $T_2$ forms at 2 the other end of the dipole. The diode D is connected with the anode at 3 and with the cathode at 4.

In operation, the DC voltage U to be regulated or limited is applied between the terminals 1 and 2, terminal 1 being positive. Assuming the applied voltage to be above the limiting value of the circuit, the transistors $T_1$ and $T_2$ will be in their conductive states, biasing diode D into its forward conducting state.

Figure 2:
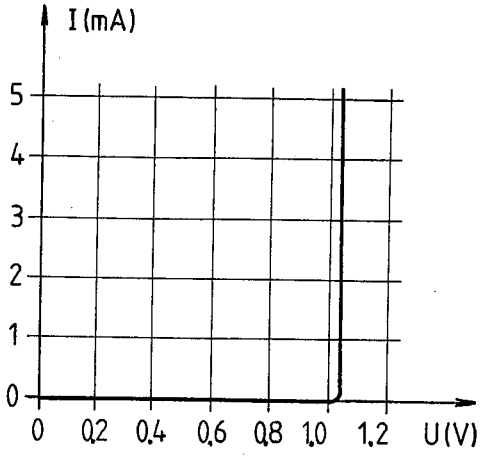
FIG. 2 is a plot of current versus voltage, illustrating the operation of the circuit of FIG. 1.

The current-voltage characteristic of FIG. 1 is shown in FIG. 2. As seen, the curve has a sharp knee at approximately 1 volt and rises substantially vertically from that point. From the characteristic curve it is apparent that the circuit of the invention not only provides voltage stabilization at a very low voltage value, but also has a very low dynamic resistance ($\Delta U/\Delta I$), as compared to devices such as the conventional Zener diode.

Figure 3:
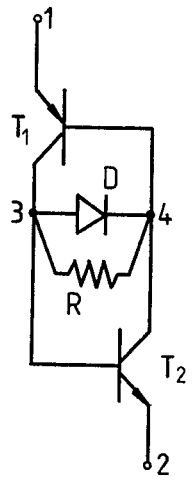
FIG. 3 is a circuit diagram of another embodiment of the invention.

In the embodiment of FIG. 3, a resistor R is connected in parallel with the diode D. The primary role of the resistor R is to sharpen the curve of the characteristic when necessary.

The characteristic U-I of FIG. 2 was obtained by measurements on the circuit of FIG. 1, i.e., without resistor R, having the following elements:

$T_1$—BC212A, manufacturers Ei $T_2$—BC182, manufacturers Ei

D—AAZ21 , manufacturers Ei ,

It will be understood that the circuits of the invention can be fabricated using integrated circuit techniques, as well as with discrete components.

I claim:

1. In a two terminal voltage limiter circuit including a transistor of the PNP type having emitter base and collector electrodes;

a transistor of the NPN type having emitter base and collector electrodes;

the collector of the PNP transistor being connected to the base of the NPN transistor and the collector of the NPN transistor being connected to the base of the PNP transistor; and wherein said transistors are rendered conductive upon application of a predetermined unidirectional voltage between their respective emitter electrodes, with the positive polarity of said voltage being applied only to the emitter of said PNP transistor and the negative polarity of said voltage being applied only to the emitter of said NPN transistor, the improvement comprising:

a diode having an anode and a cathode and having a predetermined conduction characteristic in its forward conducting direction, the anode of said diode being connected in common to the collector of the PNP transistor and the base of the NPN transistor, and the cathode of said diode being connected in common to the collector of the NPN transistor and the base of the PNP transistor;

said diode thereby never being reverse biased and being forward biased when said transistors are in a conductive state;

the characteristic of said diode combining with the characteristics of said interconnected transistors to provide a voltage limiting action across the emitter terminals at voltage and current levels substantially lower than the operating ranges of Zener diodes.

2. The voltage limiter circuit of claim 1 further comprising a resistor connected in parallel with said diode.

* * * * *